US007246458B2

(12) United States Patent
Ternovits et al.

(10) Patent No.: US 7,246,458 B2
(45) Date of Patent: Jul. 24, 2007

(54) MESSAGE BOARD ASSEMBLY

(75) Inventors: Scott Ternovits, Chicago, IL (US); Andrew Manocheo, Chicago, IL (US); Shawn Stokes, Omaha, NE (US)

(73) Assignee: ACCO Brands USA LLC, Lincolnshire, IL (US)

( * ) Notice: Subject to any disclaimer, the term of this patent is extended or adjusted under 35 U.S.C. 154(b) by 0 days.

(21) Appl. No.: 10/836,126

(22) Filed: Apr. 30, 2004

(65) Prior Publication Data

US 2005/0241197 A1 Nov. 3, 2005

(51) Int. Cl.
*G09F 7/04* (2006.01)

(52) U.S. Cl. ..... 40/600; 40/621

(58) Field of Classification Search ..... 40/412, 40/416, 421, 661.01, 600
See application file for complete search history.

(56) References Cited

U.S. PATENT DOCUMENTS

| | | | | |
|---|---|---|---|---|
| 3,093,919 | A * | 6/1963 | Holtz | 40/621 |
| 3,839,130 | A * | 10/1974 | Dean et al. | 428/43 |
| 5,503,891 | A * | 4/1996 | Marshall et al. | 428/99 |
| 5,547,198 | A * | 8/1996 | Kaiser | 273/243 |
| 2004/0110032 | A1 * | 6/2004 | Staadecker et al. | 428/692 |
| 2004/0211099 | A1 * | 10/2004 | Therrell et al. | 40/124.16 |

* cited by examiner

*Primary Examiner*—Cassandra Davis
(74) *Attorney, Agent, or Firm*—Michael Best & Friedrich LLP

(57) ABSTRACT

A message board assembly including a support layer, a top layer, and a magnetic attachment layer. The top layer is coupled to a top surface of the support layer and may include a dry erase surface. The magnetic attachment layer is coupled to a bottom surface of the support layer and extends substantially across the entirety of the bottom surface.

8 Claims, 5 Drawing Sheets

MESSAGE BOARD ASSEMBLY

FIELD OF THE INVENTION

The invention relates to message board assemblies, and more particularly to message board assemblies including a magnet.

BACKGROUND OF THE INVENTION

Message board assemblies are useful in home and office applications as they allow a user to display information. When the message board assembly includes a dry erase surface, the information may be displayed for a time and then erased when no longer needed. It is desirable to provide a convenient method for attaching the message board assemblies to common surfaces found in home and office environments to facilitate use of the boards.

SUMMARY OF THE INVENTION

The present invention provides a message board assembly having a support layer and a magnetic attachment layer. The support layer has a first surface and a second surface. The magnetic attachment layer is coupled to the second surface of the support layer and extends substantially across the entirety of the second surface. In one embodiment, the message board assembly also includes a top layer coupled to the first surface of the support layer that is designed to accept information from a user.

The invention also provides a method of making a message board assembly. The method includes forming a support layer having a first surface and a second surface, the second surface having first and second dimensions, and attaching a magnet to the second surface of the support layer. The magnet also includes first and second dimensions that are substantially equal to the first and second dimensions of the second surface, respectively.

Other features and advantages of the invention will become apparent to those skilled in the art upon review of the following detailed description, claims, and drawings.

Figure 1:
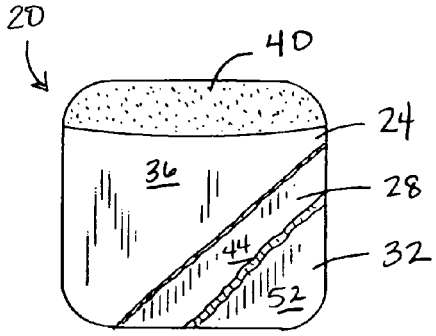
FIG. 1 is a cutaway view of a message board assembly according to the present invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including," "having," and "comprising" and variations thereof herein is meant to encompass the items listed thereafter and equivalents thereof as well as additional items.

DETAILED DESCRIPTION

Figure 2:
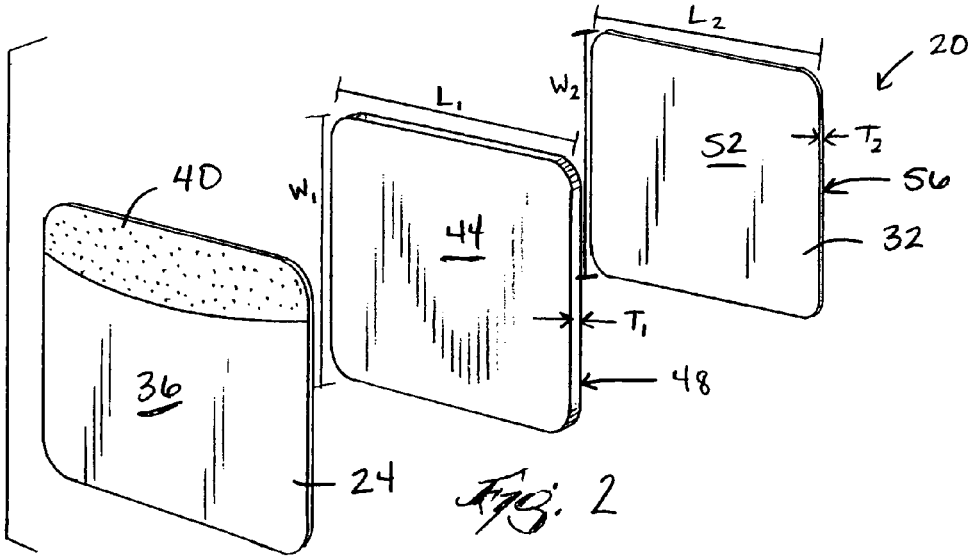
FIG. 2 is an exploded view of the message board assembly of FIG. 1.

FIGS. 1 and 2 illustrate a message board assembly 20 embodying the present invention. The message board assembly 20 includes a top layer 24, a support layer 28, and a bottom layer. In the illustrated embodiment, the bottom layer is a magnet 32.

The top layer 24 comprises a layer of paper treated, such as with a UV coating, to form a dry erase surface 36. The dry erase surface 36 allows the user to add and remove information to the message board assembly 20 easily, increasing the functionality of the message board. It is understood that other methods for treating paper to form a dry erase surface are possible, such as enamel coating or other coatings, and still fall within the scope of the present invention. It should also be understood that the top layer 24 could also instead comprise any material that is capable of forming a dry erase surface, such as painted steel or plastic.

Figure 7:
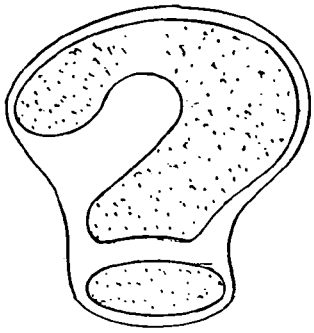
FIG. 7 is a front view of another embodiment of a message board assembly according to the present invention.
Figure 8:
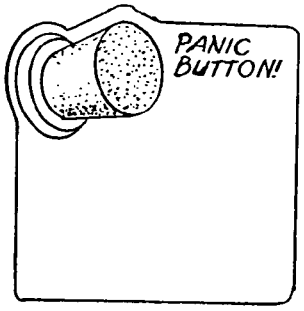
FIG. 8 is a front view of another embodiment of a message board assembly according to the present invention.
Figure 9:
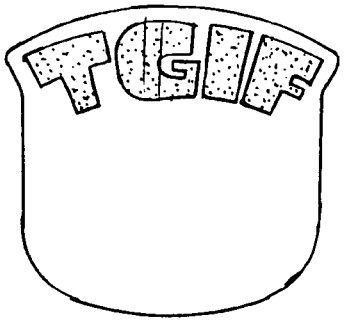
FIG. 9 is a front view of another embodiment of a message board assembly according to the present invention.
Figure 10:
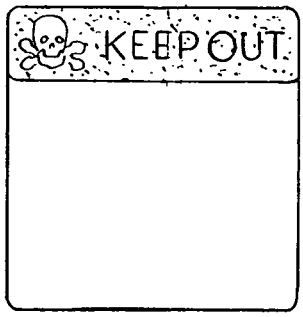
FIG. 10 is a front view of another embodiment of a message board assembly according to the present invention.
Figure 11:
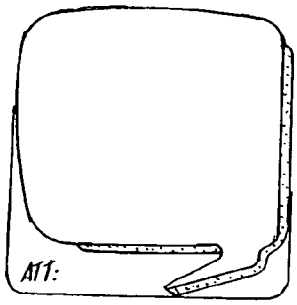
FIG. 11 is a front view of another embodiment of a message board assembly according to the present invention.
Figure 12:
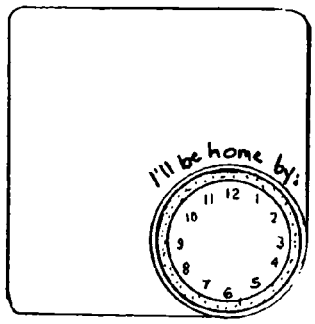
FIG. 12 is a front view of another embodiment of a message board assembly according to the present invention.
Figure 13:
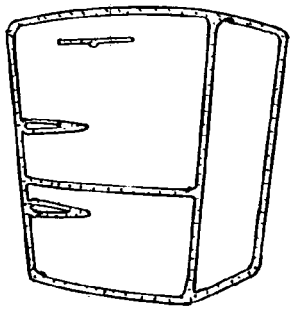
FIG. 13 is a front view of another embodiment of a message board assembly according to the present invention.
Figure 14:
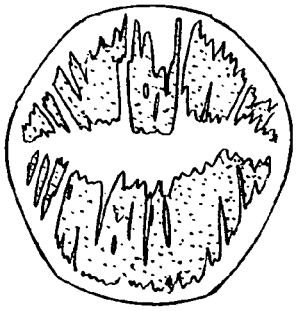
FIG. 14 is a front view of another embodiment of a message board assembly according to the present invention.

The top layer 24 also includes a shaded area 40 that is a different color than the remainder of the top layer 24. The shaded area 40 can take any shape and in some embodiments can also include text. For example, the shaded area of FIG. 7 forms a commonly recognized question mark shape, and the shaded area of FIG. 10 includes the text "Keep Out". In some embodiments, the shaded area 40 may include an outline or border that is in a different color that surrounds an area having the same color as the remainder of the top layer 24. It is understood that the shading can take any shape or color to give the message board assembly 20 a distinctive design. Alternatively, the assembly 20 could have no shading.

The support layer 28 increases the durability of the message board assembly 20 and, in the illustrated embodiment, comprises pressed chipboard. It is understood that in other embodiments, the support layer 28 can comprise PVC foam (such as the PVC foam sold under the name CINTRA), cardboard, paperboard, corkboard, sheet vinyl, rubber, or any other appropriate material. It is further understood that the chipboard could be recycled chipboard or virgin chipboard.

The support layer 28 includes a first surface 44 and a second surface 48. The top layer 24 is adhered to the first surface 44 of the support layer 28. As best shown in FIG. 2, the support layer 28 includes a first dimension such as a length $L_1$, a second dimension such as a width $W_1$, and a third dimension such as a thickness $T_1$.

The magnet 32 comprises a rubber material having magnetic ferrous particles and includes a first surface 52 coupled to the second surface 48 of the support layer 28 by an adhesive, such as glue. In the illustrated embodiment, the glue used is a PVA and water-based glue, available from GTM of Corona, Calif. It is understood that in other embodiments, any type of glue, epoxy, or pressure sensitive adhesive can be used and still fall within the scope of the present invention.

The magnet 32 also includes a second surface 56 along which the message board assembly 20 is attached to a support surface (not shown), such as a refrigerator or other surface designed to accept a magnetic material. The magnet 32 has a first dimension such as a length $L_2$, a second dimension such as a width $W_2$, and a third dimension such as a thickness $T_2$. In the illustrated embodiment, the length $L_2$ and width $W_2$ of the magnet 32 are equal to the length $L_1$ and width $W_1$ of the support layer 28, such that the magnet 32 covers the entirety of the second surface 48 of the support layer 28.

Figure 5:
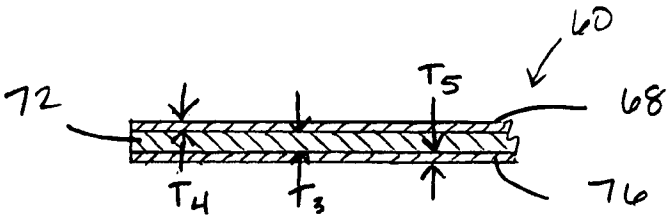
FIG. 5 is a section view of the message board assembly of FIG. 4 taken along line 5-5.

Because the display board assembly 20 of the invention includes a magnet 32 that covers the entirety of the second surface 48, a magnet 32 that is thin relative to the support layer 28 can be used and still achieve the desired magnetic holding properties. With reference to FIGS. 2 and 5, the thickness $T_1$ of the support layer 28 is on the order of twice as thick as the thickness $T_2$ of the magnet 32, such that the magnet 32 is thin compared to the support layer 28. It is understood that the ratio between the support layer thickness $T_1$ and the magnet thickness $T_2$ can be greater than (for example, 3:1) or can be less than (for example, 1.5:1) the 2:1 ratio described above and still fall within the scope of the invention.

The board assembly 20 of the illustrated embodiment is assembled according to the following method. A sheet magnet 32 is placed on a surface with the first side 52 facing up. A sheet of chipboard, which forms the support layer 28, is laminated (i.e., glue is applied to it) and placed on the magnet 32, aligned at one corner, such that the second surface 48 of the support layer 28 is in contact with the first surface 52 of the magnet 32. The paper for the top layer 24 is printed on one side to form the shaded area 40, treated to form the dry erase surface 36, and then glue is applied on the non-printed side. The top layer 24 is then laid on the first surface 44 of the support layer 28 and aligned at the same corner as the magnet 32 and support layer 28 discussed above such that the dry erase surface 36 is facing up.

The top layer 24, support layer 28, and magnet 32 are now adhered to each other to form a board assembly blank from which the finished board assemblies 20 will be cut. The blank is allowed to cure for several hours, and then the blank is inserted into a die cutting machine, which cuts the blank into a given number of the finished board assemblies 20.

Figure 3:
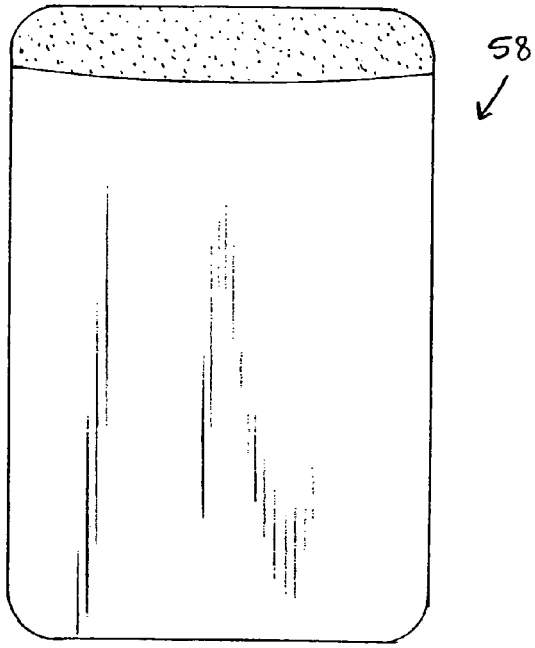
FIG. 3 is a front view of another embodiment of a message board assembly according the present invention.

The board assembly 20 of FIGS. 1 and 2 is substantially square shaped, having dimensions of approximately three inches by three inches. However, it is understood that in other embodiments, the board assembly 20 may have any desired size and shape. For example, the board assembly 58 illustrated in FIG. 3 is substantially rectangular in shape, having dimensions of approximately five inches by eight inches. FIGS. 4-14 illustrate other embodiments of board assemblies according to the invention that have various shapes and dimensions. It is understood that still other shapes and dimensions are possible for the board assembly and still fall within the scope of the invention.

Figure 4:
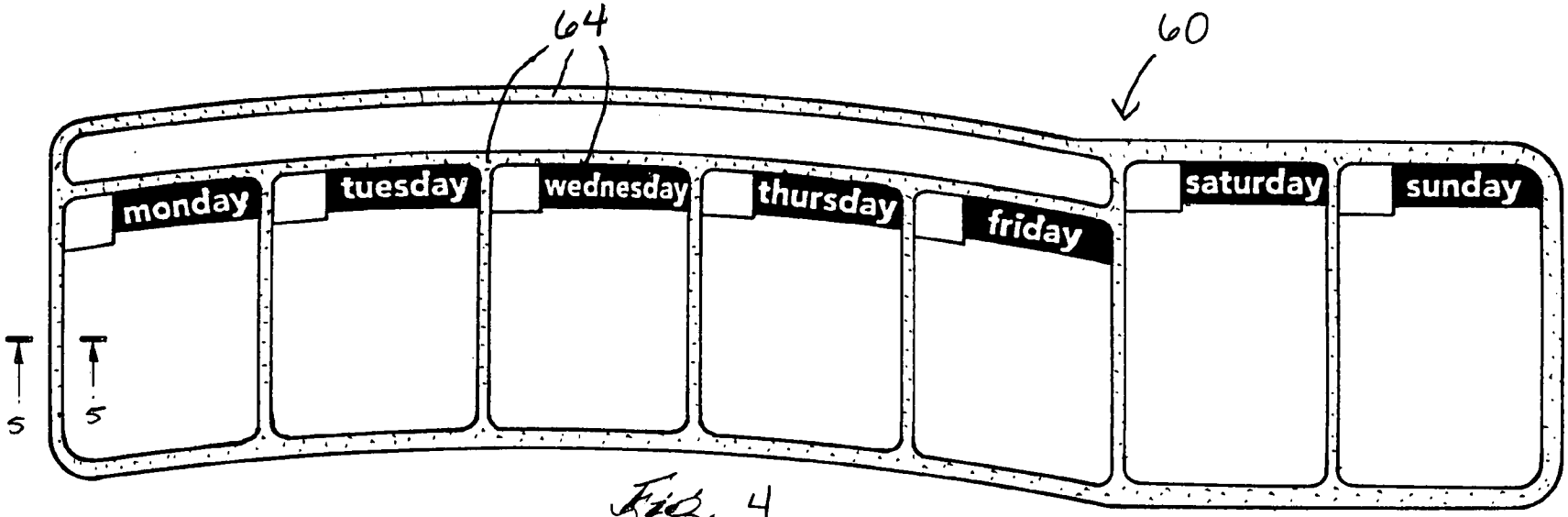
FIG. 4 is a front view of another embodiment of a message board assembly according to the present invention.

The board assembly 60 of FIG. 4 is assembled according to the method discussed above with respect to FIG. 1, and includes shaded areas 64 such that it resembles the seven days in a week. With reference to FIG. 5, the board assembly 60 includes a top layer 68, a support layer 72, and a magnet 76 that are substantially the same as those discussed above with respect to FIG. 1. The support layer 72 includes a thickness $T_3$ that is substantially equal to twice the thickness $T_5$ of the magnet 76.

Figure 6:
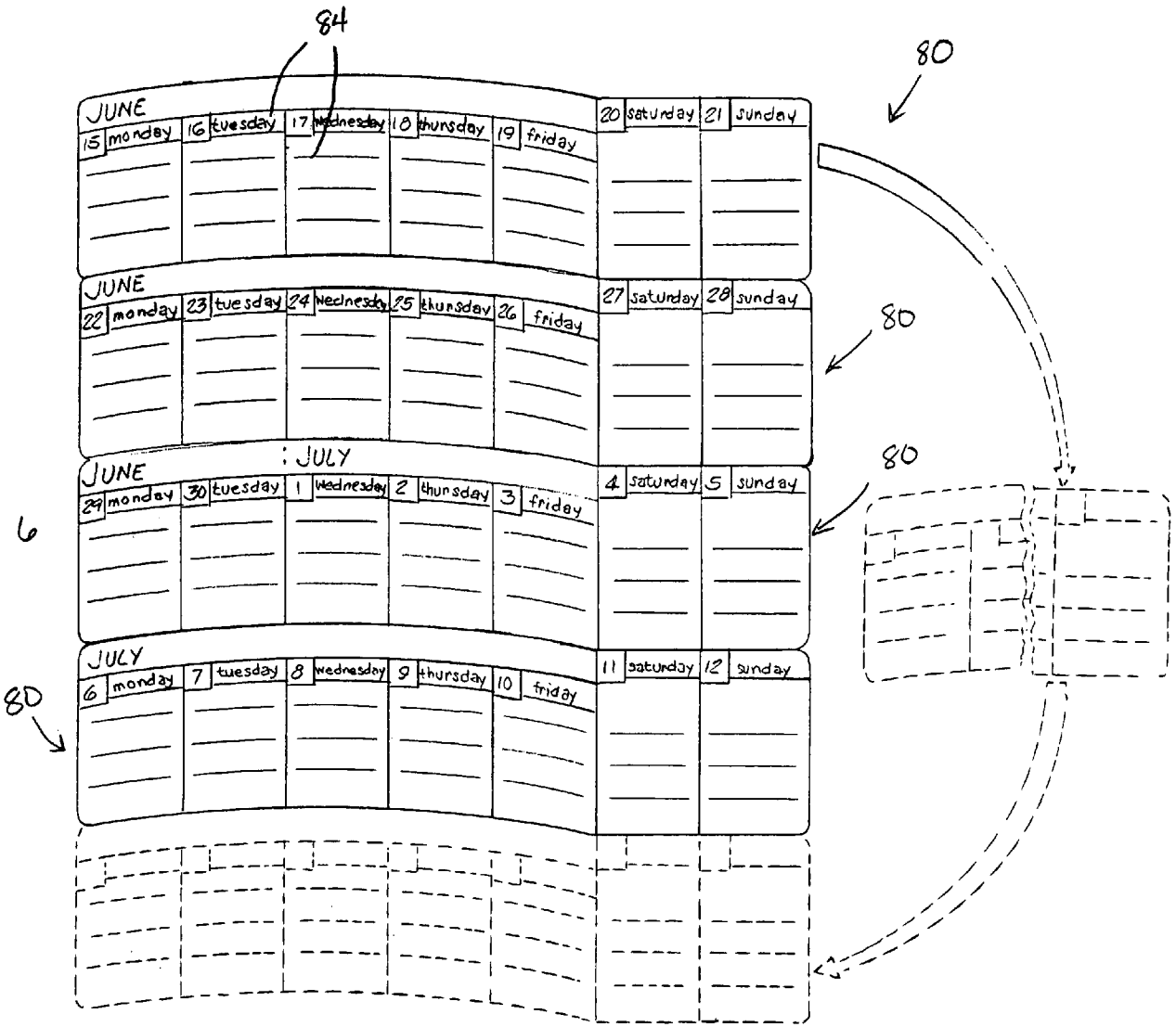
FIG. 6 is a front view of a group of message board assemblies similar to the design of FIG. 4, arranged in the configuration of a calendar.

FIG. 6 illustrates the use of the board assembly 60 to create a revolving four-week calendar. For illustration purposes, exemplary dates (i.e., June 15, 16, etc.) are included on the board assemblies 80 to illustrate how the board assemblies 80 could be used as a monthly calendar. As shown in FIG. 6, the calendar configuration allows the user to keep weekly notes on activities, appointments, etc.

FIGS. 7-14 illustrate additional embodiments of message board assemblies according to the invention, having various distinct shapes and configurations. The board assemblies of FIGS. 7-14 are assembled according to the same method discussed above with respect to FIG. 1.

Various features of the invention are set forth in the following claims.

The invention claimed is:

1. A message board assembly configured to be attached to a support surface, the message board assembly comprising:

a rigid support layer having a first surface and a second surface, the rigid support layer increasing the durability of the message board assembly;

a magnet layer having a first surface and a second surface, the first surface of the magnet layer being coupled to the second surface of the support layer, the magnet layer extending substantially across the entirety of the second surface and the magnet layer being thin relative to the rigid support layer; and a top layer coupled to the first surface of the support layer, the top layer designed to accept information from a user.

2. The message board assembly of claim 1, wherein the rigid support layer includes pressed chipboard.

3. The message board assembly of claim 1, wherein the magnet layer has a thickness approximately equal to one half the thickness of the rigid support layer.

4. The message board assembly of claim 1, the magnet having a surface that is exposed when the message board assembly is not attached to the support surface.

5. The message board assembly of claim 1, wherein the top layer forms a dry erase surface.

6. The message board assembly of claim 5, wherein the top layer includes paper treated with a UV coating.

7. A message board assembly configured to be attached to a support surface, the message board assembly comprising:

a rigid support layer having a first surface and a second surface, the rigid support layer increasing the durability of the message board assembly; and a magnet layer having a first surface and a second surface, the first surface of the magnet layer being coupled to the second surface of the support layer, the magnet layer extending substantially across the entirety of the second surface and the magnet layer being thin relative to the rigid support layer;

wherein the rigid support layer includes pressed chipboard.

8. A message board assembly configured to be attached to a support surface, the message board assembly comprising:

a rigid support layer having a first surface and a second surface, the rigid support layer increasing the durability of the message board assembly; and a magnet layer having a first surface and a second surface, the first surface of the magnet layer being coupled to the second surface of the support layer, the magnet layer extending substantially across the entirety of the second surface and the magnet layer being thin relative to the rigid support layer;

wherein the magnet layer has a thickness approximately equal to one half the thickness of the rigid support layer.

* * * * *